US006439963B1

(12) United States Patent
Rangarajan et al.

(10) Patent No.: US 6,439,963 B1
(45) **Date of Patent: *Aug. 27, 2002**

(54) SYSTEM AND METHOD FOR MITIGATING WAFER SURFACE DISFORMATION DURING CHEMICAL MECHANICAL POLISHING (CMP)

(75) Inventors: Bharath Rangarajan, Santa Clara; Bhanwar Singh, Morgan Hill; Ursula Q. Quinto, San Jose, all of CA (US)

(73) Assignee: Advanced Micro Devices, Inc., Sunnyvale, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 24 days.

(21) Appl. No.: 09/429,428

(22) Filed: Oct. 28, 1999

(51) Int. Cl.[7] ..... B24B 1/00

(52) U.S. Cl. ..... 451/8; 451/11; 451/41; 451/285

(58) Field of Search ..... 451/8, 11, 41, 451/285, 287

(56) References Cited

U.S. PATENT DOCUMENTS 5,081,796 A * 1/1992 Schultz
5,702,290 A 12/1997 Leach ..... 451/41
5,816,891 A * 10/1998 Woo
5,837,807 A 11/1998 Abrecht et al. ..... 530/317
5,882,244 A * 3/1999 Hiyama et al.
6,004,187 A * 12/1999 Nyui et al.
6,033,987 A * 3/2000 Lin et al.
6,139,400 A * 10/2000 Sato et al.

* cited by examiner

*Primary Examiner*—Timothy V. Eley
*Assistant Examiner*—Willie Berry, Jr.
(74) *Attorney, Agent, or Firm*—Amin & Turocy, LLP

(57) ABSTRACT

The present invention relates to a system for mitigating wafer disformation. The system includes at least a first polishing pad and a second polishing pad for polishing a wafer surface. A CMP drive system selectively applys the first and second polishing pads against the wafer surface at first and second pressures, respectively. A measuring system measures a wafer surface thickness associated with a first circumferential region of the wafer polished by the first polishing pad and a wafer surface thickness associated with a second circumferential region of the wafer polished by the second polishing pad. A processor employs information from the measuring system to control the CMP drive system.

16 Claims, 5 Drawing Sheets

SYSTEM AND METHOD FOR MITIGATING WAFER SURFACE DISFORMATION DURING CHEMICAL MECHANICAL POLISHING (CMP)

TECHNICAL FIELD

The present invention generally relates to a system and method for mitigating wafer surface disformation during chemical mechanical polishing (CMP).

BACKGROUND OF THE INVENTION

Traditionally, integrated circuits are built upon a flat disk crystal silicon substrate referred to as a blank silicon wafer. The surface of the wafer is subdivided into a plurality of rectangular areas on which are formed photolithographic images.

The ever increasing demand for miniaturization in the field of integrated circuits results in a corresponding demand for increased device density. Moreover, market forces are creating a need to improve device yield per wafer. As a result, larger wafers are being used to yield more devices per wafer. Chemical mechanical polishing (CMP) of is often employed in integrated circuit manufacture. The chemical mechanical polishing is typically performed to remove unwanted protrusions from a surface of the wafer, planarize a surface of the wafer and/or remove a predetermined thickness of a layer on the wafer.

One undesirable consequence of performing CMP on large size wafers is dishing and/or bowing of the wafer surface as a result of differing pressure gradients during CMP. Prior art FIG. 1*a* illustrates a wafer 10 that has been disformed by a CMP process so as to dish as a result of differing pressure gradients during CMP. Prior art FIG. 1*b* illustrates a wafer 12 that has been disformed by a CMP process so as to bow as a result of differing pressure gradients during CMP. Such dishing or bowing of the wafer is undesirable because it contributes to non-uniformity of integrated circuits formed from the wafer, and/or device defects.

Accordingly, there is a need for a solution to mitigate wafer disformation.

SUMMARY OF THE INVENTION

The present invention provides for a system and method for mitigating wafer disformation during chemical mechanical polishing (CMP). In accordance with a preferred embodiment of the present invention, two or more polishing pads are employed to concurrently polish a wafer surface. Each pad is applied at a different pressure so as to minimize differing pressure gradients during CMP. A feedback system is employed in connection with each pad to facilitate determining the thickness of the region of material being polished by each pad respectively. The feedback information is employed to adjust the pressure of the respective pads so as to mitigate disformation of the wafer during CMP.

One particular aspect of the present invention relates to a system for mitigating wafer disformation. The system includes at least a first polishing pad and a second polishing pad for polishing a wafer surface. A CMP drive system selectively applys the first and second polishing pads against the wafer surface at first and second pressures, respectively. A measuring system measures a wafer surface thickness associated with a first circumferential region of the wafer polished by the first polishing pad and a wafer surface thickness associated with a second circumferential region of the wafer polished by the second polishing pad. A processor employs information from the measuring system to control the CMP drive system.

Another aspect of the present invention relates to a system for mitigating wafer disformation. At least a first polishing pad and a second polishing pad polish a wafer surface. The system includes a first optical waveguide associated with the first polishing pad and a second optical waveguide associated with the second polishing pad. A CMP drive system selectively applies the first and second polishing pads against the wafer surface at first and second pressures, respectively. A measuring system measures a wafer surface thickness associated with a first circumferential region of the wafer polished by the first polishing pad and a wafer surface thickness associated with a second circumferential region of the wafer polished by the second polishing pad. A processor employs information from the measuring system to control the CMP drive system.

Yet another aspect of the present invention relates to a system for mitigating wafer disformation, including: at least a first polishing pad and a second polishing pad for polishing a wafer surface; means for selectively applying the first and second polishing pads against the wafer surface at first and second pressures, respectively; means for measuring a wafer surface thickness associated with a first circumferential region of the wafer polished by the first polishing pad and a wafer surface thickness associated with a second circumferential region of the wafer polished by the second polishing pad; and means employing information from the measuring system to control the means for selectively applying the first and second polishing pads against the wafer surface at first and second pressures.

Still yet another aspect of the present invention relates to a system for mitigating wafer disformation, including: a polishing pad for polishing a wafer surface; a CMP drive system for selectively applying the polishing pad against a first circumferential region of the wafer surface at a first pressure and applying the polishing pad against a second circumferential region of the wafer surface at a second pressure; a system for measuring a wafer surface thickness associated with the first circumferential region and a wafer surface thickness associated with the second circumferential region of the wafer; and a processor for employing information from the measuring system, the processor employing the information to control the CMP drive system.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
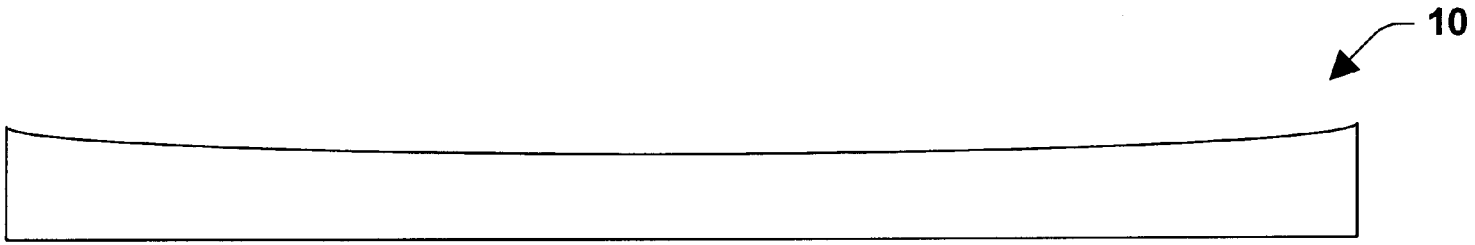
Fig. 1a Prior Art
FIG. 1*a* is a perspective illustration of a wafer that was disformed (dished) as a result of a conventional CMP process.
Figure 1B:
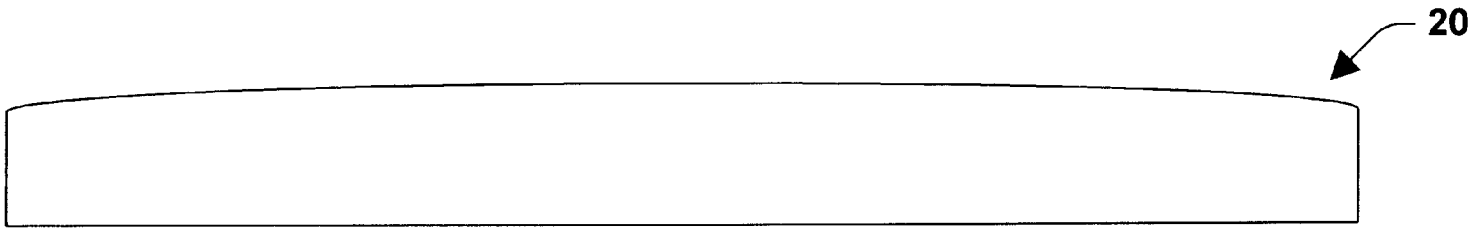
Fig. 1b Prior Art
FIG. 1*b* is a perspective illustration of a wafer that was disformed (bowed) as a result of a conventional CMP process.

The present invention will now be described with reference to the drawings, wherein like reference numerals are used to refer to like elements throughout. The following detailed description is of the best modes presently contemplated by the inventors for practicing the invention. It should be understood that the description of this preferred embodiment is merely illustrative and that it should not be taken in a limiting sense.

Figure 2:
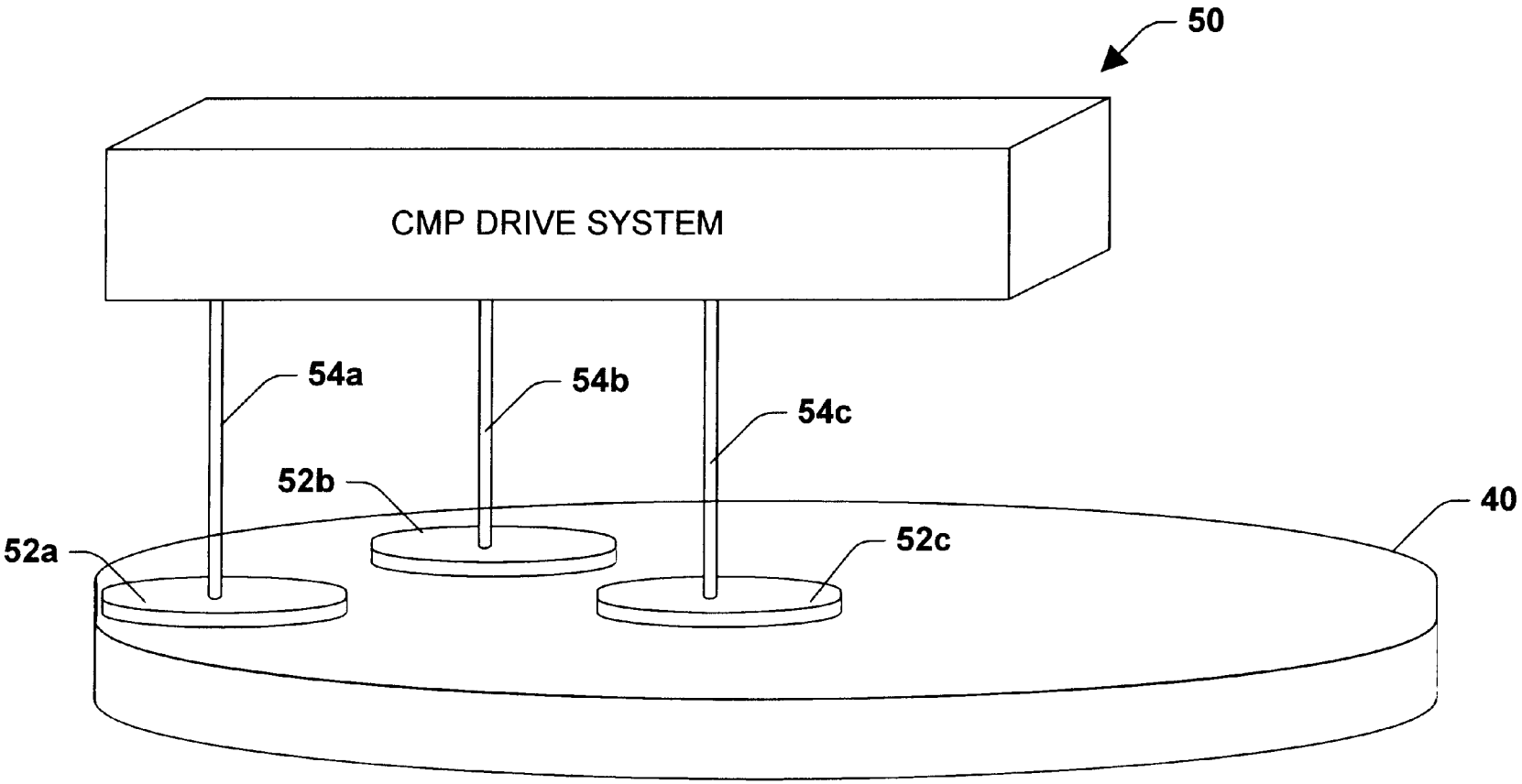
FIG. 2 is a representative perspective illustration of a CMP drive system in accordance with the present invention.

FIG. 2 is a representative schematic illustration of a wafer 40 being polished by CMP drive system 50 in accordance with the present invention. The CMP drive system 50 includes a plurality of polishing pads 52*a*, 52*b* and 52*c* (collectively referenced by numeral 50) which are driven by respective spindles 54*a*, 54*b* and 54*c*. Although the present invention is described herein with respect to three polishing pads 54, it is to be appreciated that any suitable number of polishing pads 52 may be employed to carry out the present invention.

The polishing process includes the use of a slurry (not shown) deposited over the wafer surface and a chemical mechanical polishing (CMP) procedure to essentially rub the slurry 80 over the surface so as to polish the surface to remove undesired features, create a desired planarization and/or removed a predifferent material layer thickness. The slurry 80 may be suitably tailored with respect to granularity so as to result in a desired surface texture and to facilitate removal of material layer portions. Some types of slurry compositions which may be employed to carry out the present invention include silica and/or alumina slurries such as those sold by Cabot Corp. and Rodel Inc.

The polishing pads 52 used in the CMP procedure may be individually selected in accordance with a desired amount of material layer to be removed. The harder the polishing pad the greater the amount of material layer removed. For example, for a large amount of material layer to be removed, a hard polishing pad (e.g., hard polyurethane pad such as a Rodel IC 1000) may be employed. For removal of a moderate level of material layer, a medium hardness polishing pad (e.g., Rodel Suba 500) may be employed. For removal of a relatively small amount of material layer, a soft polishing pad may be employed.

As will be discussed in greater detail below, the applied pressure and/or rate of spindle rotation of the respective pads is controlled so as to mitigate wafer deformation (e.g., dishing and/or bowing of the wafer). For example, polishing pad 52*a* (relating to an outer circumferential area of the wafer 40) is applied at a pressure P1; polishing pad 52*b* (relating to a circumferential area inner to that of the outermost circumferential area of the wafer 40) is applied at a pressure P2; and polishing pad 52*c* (relating to an innermost circumferential area of the wafer 40) is applied at a pressure P3. The pressure of the pads 52 is applied such that P1>P2>P3. The pressure of the various pads 54 as applied against the wafer surface is varied so as to compensate for differing pressure gradients.

Figure 3B:
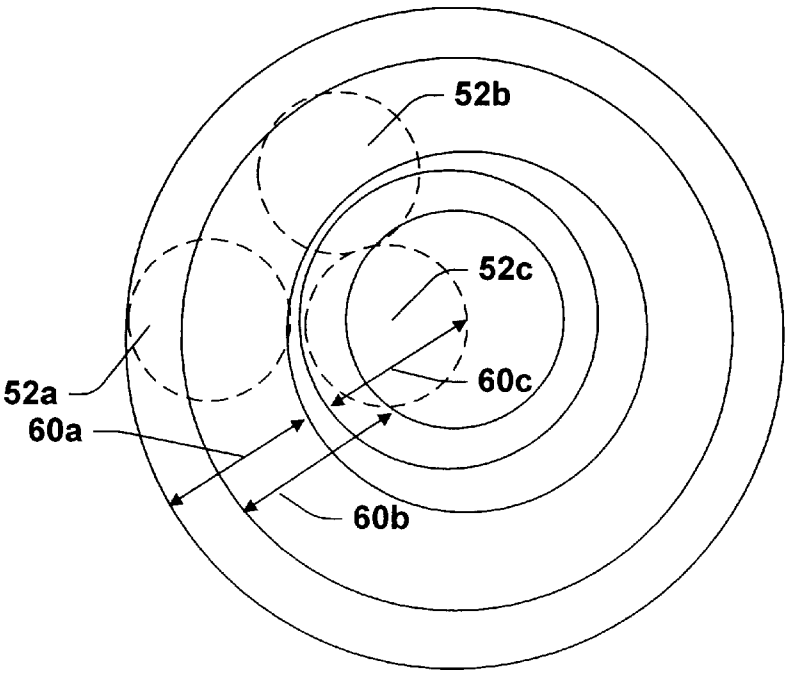
FIG. 3*b* is a representative schematic illustration of a top view of the wafer and polishing pads of FIG. 3*a* with the polish regions of each respective pad delineated in accordance with the present invention.
Figure 3A:
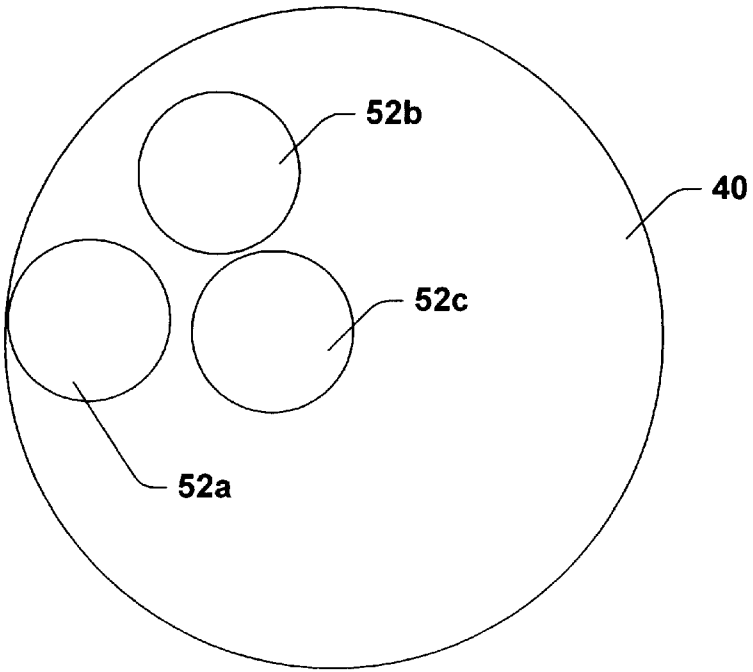
FIG. 3*a* is a representative schematic illustration of a top view of a wafer and polishing pads in accordance with the present invention.

FIG. 3*a* is a representative schematic illustration of a top view of the wafer 40 and polishing pads 52 in accordance with the present invention. The polishing pads 52 are preferably applied against the wafer 40 such that there is an overlap of polished regions between at least two respective polishing pads 52. FIG. 3*b* is a representative schematic illustration of a top view of the wafer and polishing pads of FIG. 3*a* with the polish regions of each respective pad delineated in accordance with the present invention. Polishing pad 52*a* polishes a circumferential region of the wafer identified by reference numeral 60*a*. Polishing pad 52*b* polishes a circumferential region of the wafer identified by reference numeral 60*b*. Polishing pad 52*c* polishes a circumferential region of the wafer identified by reference numeral 60*c*. As can be seen, polishing pads 52*a* and 52*b* have some overlap with respect to circumferential regions of the wafer being polished. Polishing pads 52*b* and 52*c* also have some overlap with respect to circumferential regions of the wafer 40 being polished. Overlap of regions to be polished is desired so as to mitigate edging at the outer portions of each respective circumferential region 60.

Figure 4:
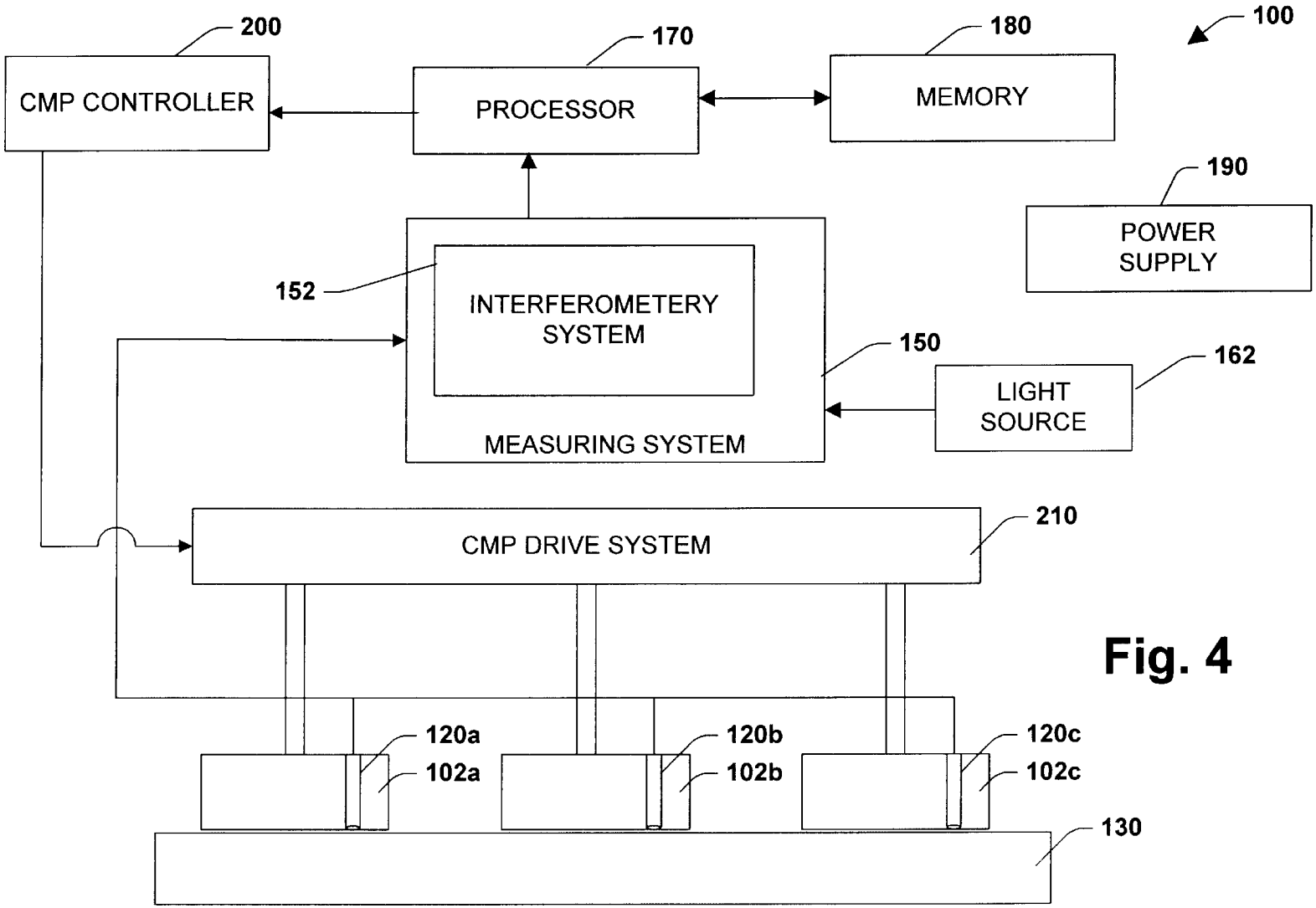
FIG. 4 is a representative schematic illustration of a system for mitigating wafer disformation in accordance with the present invention.

FIG. 4 is a representative schematic illustration of a system 100 for mitigating wafer disformation in accordance with the present invention. The system 100 includes polishing pads 102*a*, 102*b*, 102*c*, and respective spindles 104*a*, 104*b* and 104*c*. Associated with each polishing pad 102*a*, 102*b* and 102*c* is an optical wave guide (e.g., optical fiber) 120*a*, 120*b* and 120*c*, respectively.

The optical wave guides 120 project radiation onto respective portions of the surface of a wafer 130. Radiation reflected from the wafer substrate surface is processed by a measuring system 150 to measure the thickness of the material of the wafer 130 being polished. The reflected radiation is processed with respect to the incident radiation in measuring the material layer thickness.

The measuring system 150 includes an interferometry system 152. It is to be appreciated that any suitable interferometry system may be employed to carry out the present invention and such systems are intended to fall within the scope of the hereto appended claims. Interferometry systems are well known in the art, and therefore further discussion related thereto is omitted for sake of brevity.

A source 162 of monochromatic radiation such as a laser provides radiation to the plurality of optical wave guides 120 via the measuring system 150. Preferably, the radiation source 162 is a frequency stabilized laser however it will be appreciated that any laser or other radiation source (e.g., laser diode or helium neon (HeNe) gas laser) suitable for carrying out the present invention may be employed.

A processor 170 receives the measured data from the measuring system 150 and determines the thickness of the wafer material being polished. The processor 170 is operatively coupled to the measuring system 150 and is programmed to control and operate the various components within the system 100 in order to carry out the various functions described herein. The processor or CPU 170 may be any of a plurality of processors, such as the AMD K7 and other similar and compatible processors. The manner in which the processor 170 can be programmed to carry out the functions relating to the present invention will be readily apparent to those having ordinary skill in the art based on the description provided herein.

A memory 180 which is operatively coupled to the processor 170 is also included in the system 100 and serves to store program code executed by the processor 170 for carrying out operating functions of the system 100 as described herein. The memory 180 includes read only memory (ROM) and random access memory (RAM). The ROM contains among other code the Basic Input-Output System (BIOS) which controls the basic hardware operations of the system 100. The RAM is the main memory into which the operating system and application programs are loaded. The memory 180 also serves as a storage medium for temporarily storing information such as material layer thickness, spindle rotation rate, polishing pad position, interferometry information, and other data which may be employed in carrying out the present invention. For mass data storage, the memory 180 may include a hard disk drive (e.g., 100 Gigabyte hard drive).

Power supply 190 provides operating power to the system 100. Any suitable power supply (e.g., battery, line power) may be employed to carry out the present invention.

The processor 170 is also coupled to a CMP control system 200 which controls a CMP drive system 210 which drives the spindles and also applies the respective polishing pads 102 at desired pressures against the wafer surface. Each respective circumferential portion (as described in connection with FIG. 3*b*, for example) has a corresponding polishing pad 102 and optical wave guide 120 associated therewith. The processor 170 is able to monitor the thickness of the various circumferential wafer surface portions and selectively regulate the spindle drive rate and application pressure of the respective polishing pads 102. As a result, the system 100 provides for mitigating deformation of the wafer 130 as a result of CMP so as to result in a wafer polished with substantial uniformity, which in turn improves fidelity of integrated circuit fabrication.

Figure 5:
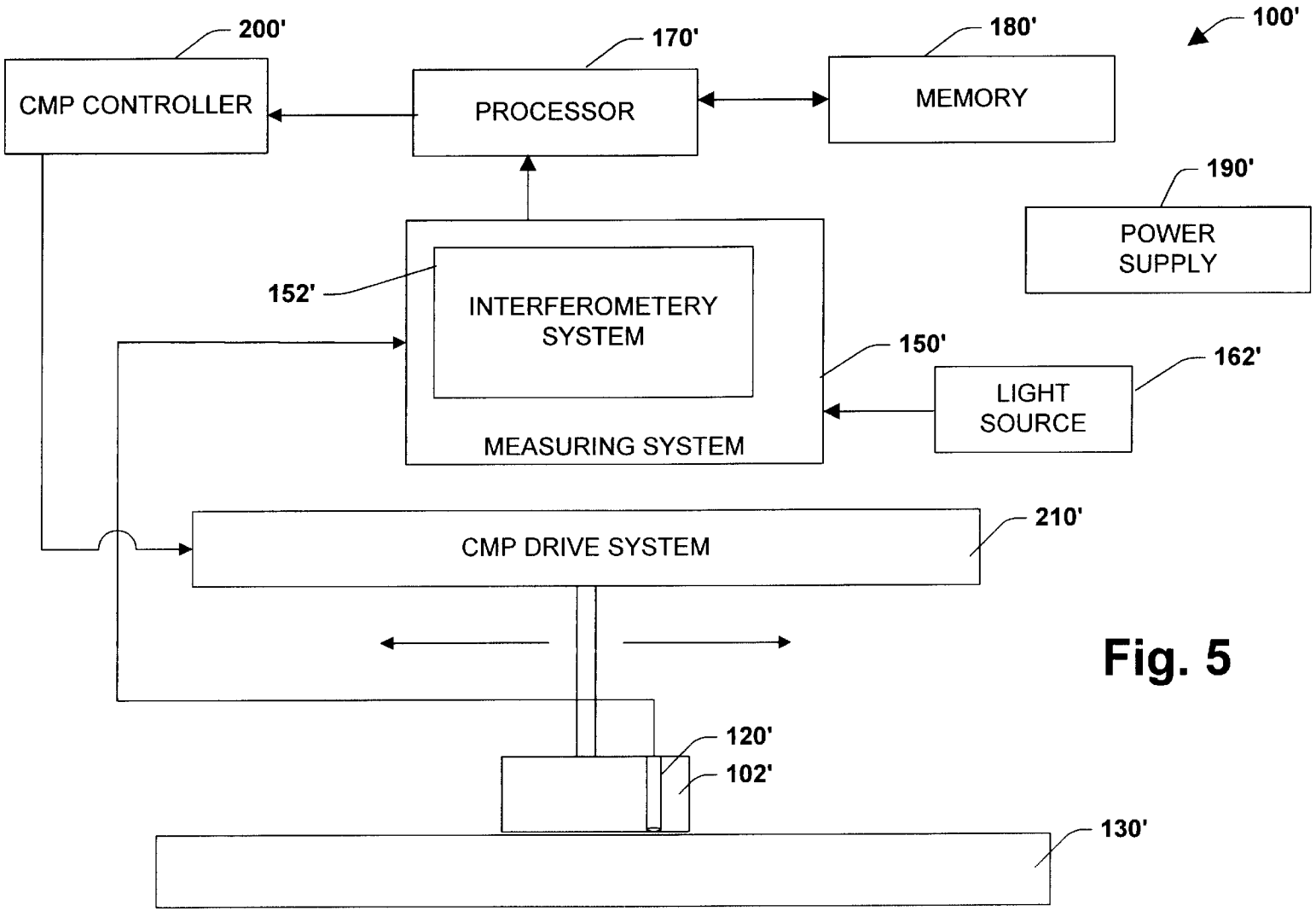
FIG. 5 is a representative schematic illustration of another system for mitigating wafer disformation in accordance with the present invention.

FIG. 5 schematically illustrates another embodiment of a system 100' for mitigating wafer disformation which may be employed in carrying out the present invention. The system 100' only includes a single spindle $S_S$ and a single corresponding pad $P_S$ The spindle $S_S$ is adapted to be moveable horizontally as well as vertically. Accordingly, the spindle $S_S$ and pad $P_S$ may be employed to polish various circumferential regions of a wafer 130'. More particularly, the spindle $S_S$ and pad $P_S$ may be positioned to polish a first circumferential portion of the wafer. Next, the spindle $S_S$ and pad $P_S$ may be selected repositioned to polish a second circumferential portion of the wafer 130'. This process is repeated to polish a desired number of circumferential regions. The speed of the spindle $S_S$ and/or applied pressure of the polishing pad $P_S$ may be selectively adjusted with respect to each circumferential region so as to mitigate wafer disformation.

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for mitigating wafer disformation, comprising:

at least a first polishing pad and a second polishing pad for polishing a wafer surface;

a CMP drive system for selectively applying the first and second polishing pads against the wafer surface at first and second pressures, respectively, wherein the first pressure is different than the second pressure;

a system for measuring a wafer surface thickness associated with a first circumferential region of the wafer polished by the first polishing pad and a wafer surface thickness associated with a second circumferential region of the wafer polished by the second polishing pad; and a processor for employing information from the measuring system, the processor employing the information to control the CMP drive system.

2. The system of claim 1, further including a third polishing pad being applied against the wafer at a third pressure.

3. The system of claim 2, the first pressure being greater than the second pressure, and the second pressure being greater than the third pressure.

4. The system of claim 2, the CMP drive system rotating the first polishing pad at a different rotation rate than the second polishing pad, and the second polishing pad at a different rotation rate than the third polishing pad.

5. The system of claim 1, the CMP drive system rotating the first polishing pad at a different rotation rate than the second polishing pad.

6. A system for mitigating wafer disformation, comprising:

at least a first polishing pad and a second polishing pad for polishing a wafer surface;

a first optical waveguide associated with the first polishing pad and a second optical waveguide associated with the second polishing pad;

a CMP drive system for selectively applying the first and second polishing pads against the wafer surface at first and second pressures, respectively, wherein the first pressure is different than the second pressure;

a system for measuring a wafer surface thickness associated with a first circumferential region of the wafer polished by the first polishing pad and a wafer surface thickness associated with a second circumferential region of the wafer polished by the second polishing pad; and a processor for employing information from the measuring system, the processor employing the information to control the CMP drive system.

7. The system of claim 6, the measuring system employing interferometry techniques to facilitate determining wafer surface thickness.

8. The system of claim 6, further including a third polishing pad being applied against the wafer at a third pressure.

9. The system of claim 8, the first pressure being greater than the second pressure, and the second pressure being greater than the third pressure.

10. The system of claim 6, the CMP drive system rotating the first polishing pad at a different rotation rate than the second polishing pad.

11. The system of claim 8, the CMP drive system rotating the first polishing pad at a different rotation rate than the second polishing pad, and the second polishing pad at a different rotation rate than the third polishing pad.

12. A system for mitigating wafer disformation, comprising:

at least a first polishing pad and a second polishing pad for polishing a wafer surface;

means for selectively applying the first and second polishing pads against the wafer surface at first and second pressures, respectively, wherein the first pressure is different than the second pressure;

means for measuring a wafer surface thickness associated with a first circumferential region of the wafer polished by the first polishing pad and a wafer surface thickness associated with a second circumferential region of the wafer polished by the second polishing pad; and means employing information from the measuring system to control the means for selectively applying the first and second polishing pads against the wafer surface at first and second pressures.

13. A system for mitigating wafer disformation, comprising:

a polishing pad for polishing a wafer surface;

a CMP drive system for selectively applying the polishing pad against a first circumferential region of the wafer surface at a first pressure and applying the polishing pad against a second circumferential region of the wafer surface at a second pressure, wherein the first pressure is different than the second pressure;

a system for measuring a wafer surface thickness associated with the first circumferential region and a wafer surface thickness associated with the second circumferential region of the wafer; and a processor for employing information from the measuring system, the processor employing the information to control the CMP drive system.

14. The system of claim 13 further including an optical waveguide for directing radiation on the surface of the wafer.

15. The system of claim 14, the measuring system employing interferometry techniques to facilitate determining wafer surface thickness.

16. The system of claim 13, the CMP drive system rotating the polishing pad at a different rotation rate for the first circumferential region than the second circumferential region.

* * * * *